US007337729B2

(12) United States Patent
Briosi

(10) Patent No.: US 7,337,729 B2
(45) Date of Patent: Mar. 4, 2008

(54) MODULAR SHELVING

(75) Inventor: Antonello Briosi, Milan (IT)

(73) Assignee: Metalsistem Group S.p.A., Rovereto (IT)

( * ) Notice: Subject to any disclaimer, the term of this patent is extended or adjusted under 35 U.S.C. 154(b) by 449 days.

(21) Appl. No.: 10/917,056

(22) Filed: Aug. 12, 2004

(65) Prior Publication Data

US 2005/0061760 A1 Mar. 24, 2005

(30) Foreign Application Priority Data

Sep. 22, 2003 (IT) ..... MI2003A1801

(51) Int. Cl.
*A47B 9/00* (2006.01)

(52) U.S. Cl. ..... 108/107; 248/243

(58) Field of Classification Search ..... 108/110, 108/106, 107, 144.11, 147.11, 147.12, 147.13, 108/147.14, 147.15; 211/90.01, 90.02, 187, 211/196, 198, 207, 208; 248/219.1, 219.3, 248/219.4, 220.21, 220.43

See application file for complete search history.

(56) References Cited

U.S. PATENT DOCUMENTS

| | | | | |
|---|---|---|---|---|
| 3,332,374 | A * | 7/1967 | Ferdinand et al. | 108/107 |
| 3,456,970 | A * | 7/1969 | Sunasky | 108/110 |
| 3,498,239 | A * | 3/1970 | Bartlett et al. | 108/110 |
| 3,606,227 | A * | 9/1971 | Klein | 108/110 |
| 4,079,678 | A | 3/1978 | Champagne et al. | |
| 4,154,419 | A * | 5/1979 | Breidenbach | 108/110 |
| 4,317,523 | A | 3/1982 | Konstant et al. | |
| 4,582,001 | A * | 4/1986 | Leikarts | 108/106 |
| 4,706,576 | A * | 11/1987 | James | 108/106 |
| 4,964,350 | A * | 10/1990 | Kolvites et al. | 108/110 |
| 5,036,778 | A | 8/1991 | Briosi et al. | |
| 6,158,600 | A * | 12/2000 | Ferrucci et al. | 108/147.11 |

FOREIGN PATENT DOCUMENTS

| | | | |
|---|---|---|---|
| DE | 3933739 | A1 * | 4/1991 |
| EP | 1134170 | | 9/2001 |

OTHER PUBLICATIONS

European Search Report.

* cited by examiner

*Primary Examiner*—Jose V. Chen
(74) *Attorney, Agent, or Firm*—Bucknam and Archer

(57) ABSTRACT

A modular shelving made of metal or other suitable material, having a plurality of risers or vertical elements with a polygonal section connected by horizontal elements such as longitudinal members with a lower side facing the floor surface and cross members to form the support for shelves. On two or more faces of the side surface of the risers, are provided a plurality of shaped recesses having depth (H) and defined by opposite walls being horizontally and vertically aligned among them, put near the vertexes or edges of the risers or vertical elements and cooperating with complementary shaped and depressed impressions formed on a hose clamp comprising opposite horizontal parallel branches and a vertical branch embracing the same risers and engaging with at least one longitudinal member and/or a cross member to which they are constrained by connection border elements.

14 Claims, 7 Drawing Sheets

MODULAR SHELVING

The present invention refers to a modular shelving. More particularly, the present invention refers to an improved modular shelving which is particularly suitable for the installation in environments wherein high hygienic conditions are required which need to be protected from pollution or deterioration of substances and products.

As known, there are various types of modular shelving made of metal and used in industrial environments to create storage warehouses for goods and products.

This shelving generally comprises a plurality of risers or vertical elements, being horizontally connected among them by longitudinal elements and cross members; these components generally have a quadrangular section and are jointly fastened among them.

For the purpose, along the faces defining the side surface, the risers are provided with a plurality of equidistant hook-shaped projections or pass-through openings forming the connection and stabilization seats of the cross members and of the longitudinal members.

On the opposite ends, said longitudinal members are provided with complementary slots or teeth engaging with said risers. On the tridimensional framework which is obtained, fixed or removable shelves are placed to store products or goods.

This common solution is particularly suitable for the manufacturing of industrial shelving, but it shows a relevant drawback limiting its use in particular environments.

At least on the risers, in fact, the projections obtained on the faces to form the hooking teeth with the horizontal elements are obtained by partial sheet shearing and therefore they form the same number of small openings along the development of the same risers. If organic products are stored, such as liquid food, during the pallet handling, it may occur that some product packages get damaged due to shocks or crushing thus causing leakages of product. The liquid spreading on the shelving, unavoidably penetrates inside the risers through the openings obtained on them and it cannot be completely removed not even with high-pressure water jet machines. The fermentation or degradation of the product gives rise to the development of polluting substances or residuals being such to remarkably decrease the hygienic standards of the environment.

Moreover, through said openings of the risers, foreign bodies such as dust and insects can penetrate, the latter hide inside the shelving thus compromising its hygienic standards and the integrity of the products stored.

Therefore, this shelving is not suitable for the installation in environments wherein, on the contrary, very high hygienic standards must be assured. This kind of environments are constituted for example by chemical or pharmaceutical laboratories, hotels, industrial kitchens, hospitals, i.e. places wherein the storage of perishable products and substances, especially of liquid products, is required.

Object of the present invention is to remedy the above-mentioned drawback.

More particularly, object of the present invention is the provision of an improved modular shelving wherein the connections between risers and cross members are obtained through means which do not contemplate drillings or partial shearing on the same risers.

A further object of the invention is the provision of a shelving as defined above which consequently allows maintaining high hygienic standards and a protection from fortuitous leaks of liquids or degradable or polluting liquids or substances or of foreign bodies in the components making it.

A further object of the invention is the provision of an improved modular shelving which can assure a high resistance and reliability level in time and is easily manufactured and installed at low costs.

According to the present invention, these and other objects are reached by an improved modular shelving made of metal such as stainless steel or other suitable material comprising a plurality of risers or vertical elements with a polygonal section connected by horizontal elements such as longitudinal members and cross members forming the support for smooth, grid, fixed and removable shelves, wherein, on two or more faces of the side surface, said risers are provided with a plurality of shaped recesses horizontally and vertically aligned among them and cooperating with complementary shaped and depressed impressions formed on hose clamps embracing the same risers and engaging with at least one longitudinal member and/or a cross member to which they are fastened by connection means which are transversely inserted.

The manufacturing and functional features of the improved modular shelving of the present invention can be better understood from the following description, wherein reference is made to the attached tables of drawings representing a preferred and non-limitative embodiment, wherein.

Figure 1:
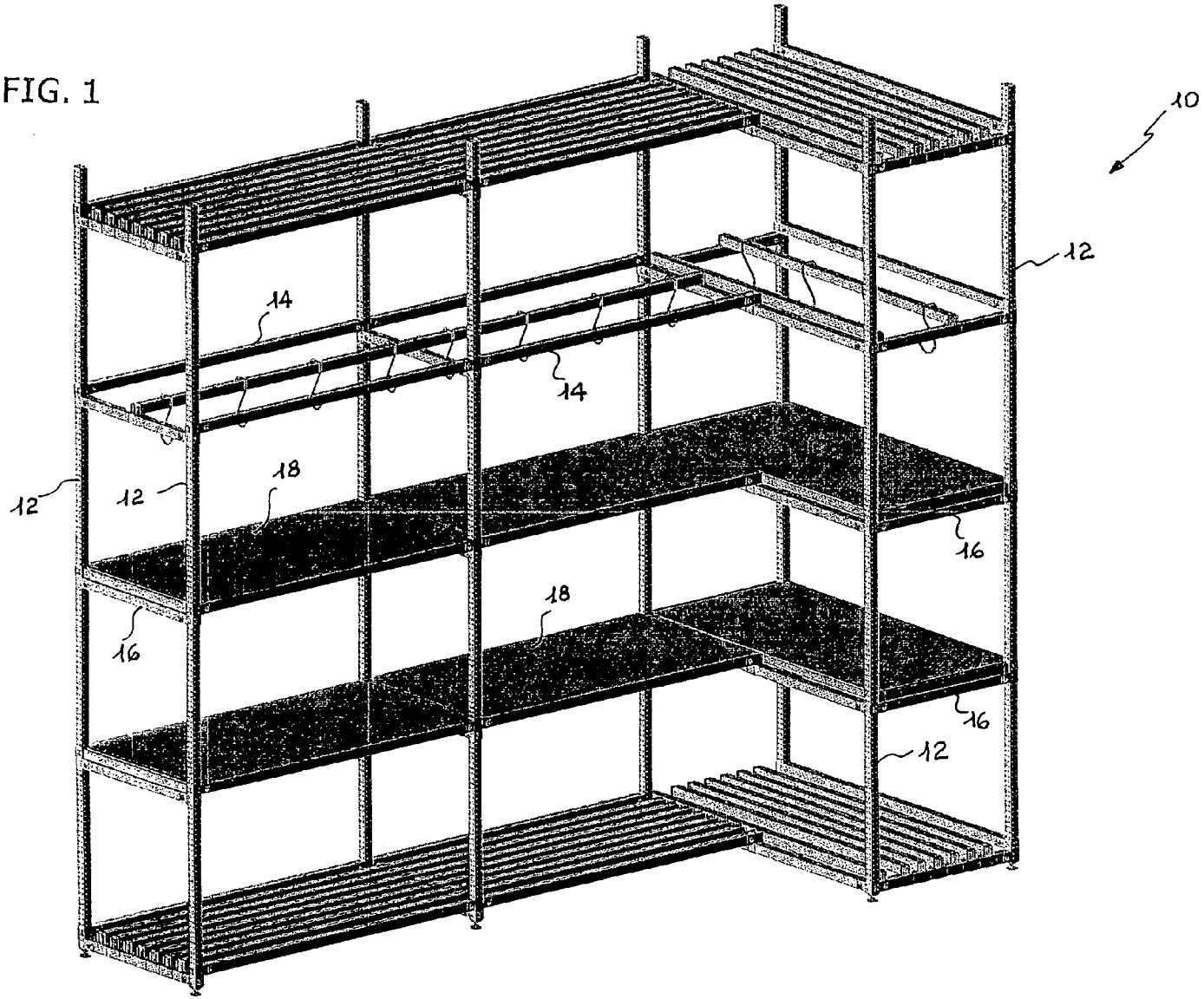
FIG. 1 is a schematic perspective view of an embodiment of the modular shelving of the present invention.

With reference to the above-mentioned Figures, the modular shelving of the present invention, marked in its whole with 10 in FIG. 1, is preferably made of stainless steel and comprises a plurality of risers or vertical elements 12 connected by horizontal elements such as longitudinal members 14 with lower side 14' facing the floor surface and cross members 16 forming the support for shelves 18 which can be fixed or removable, smooth or with grids. The space articulation and the size development of the shelving of FIG. 1 are to be meant by way of example, in the sense that the same shelving can extend without directional limits and previously defined heights according to the size and configuration of the environment wherein it is installed.

Figure 3:
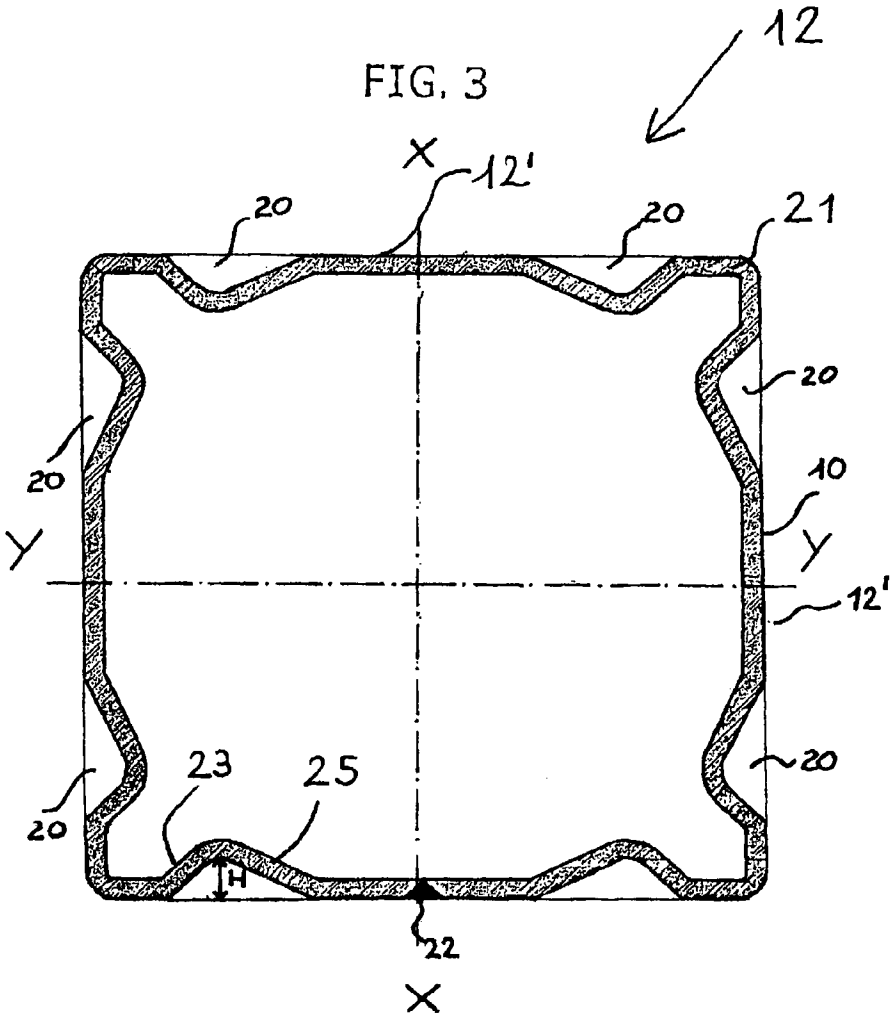
FIGS. 2 and 3 represent two schematic views of the cross section of one of the risers or vertical elements, with axes X-Y, of the shelving of FIG. 1.
Figure 2:
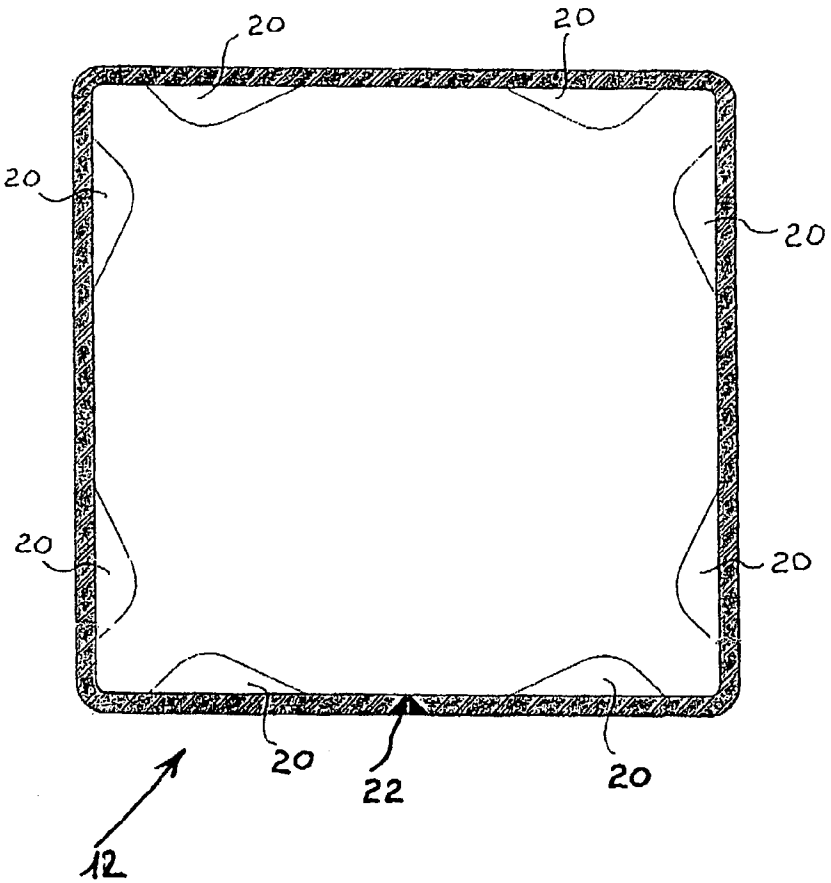
Figure 6:
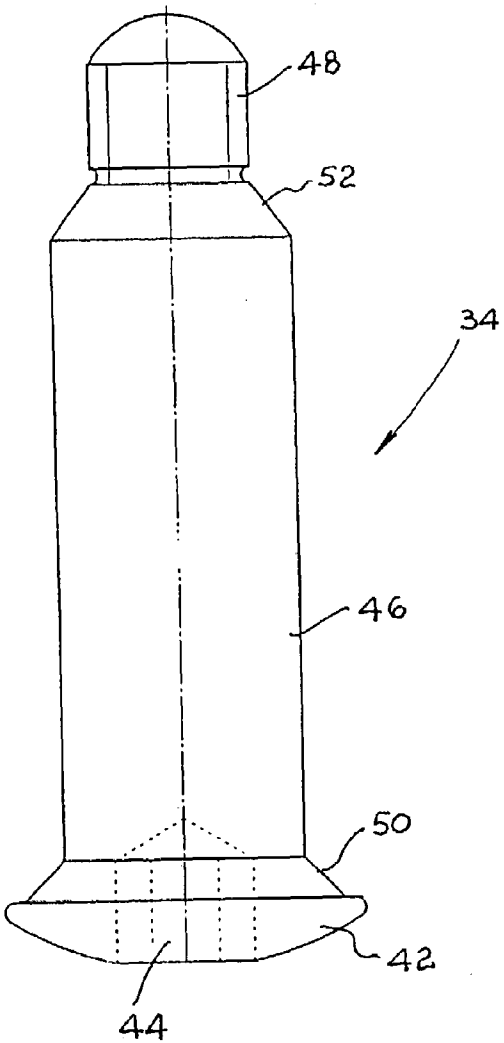
FIG. 6 is a schematic side view of the tightening pin matched with said hose clamp.
Figure 5:
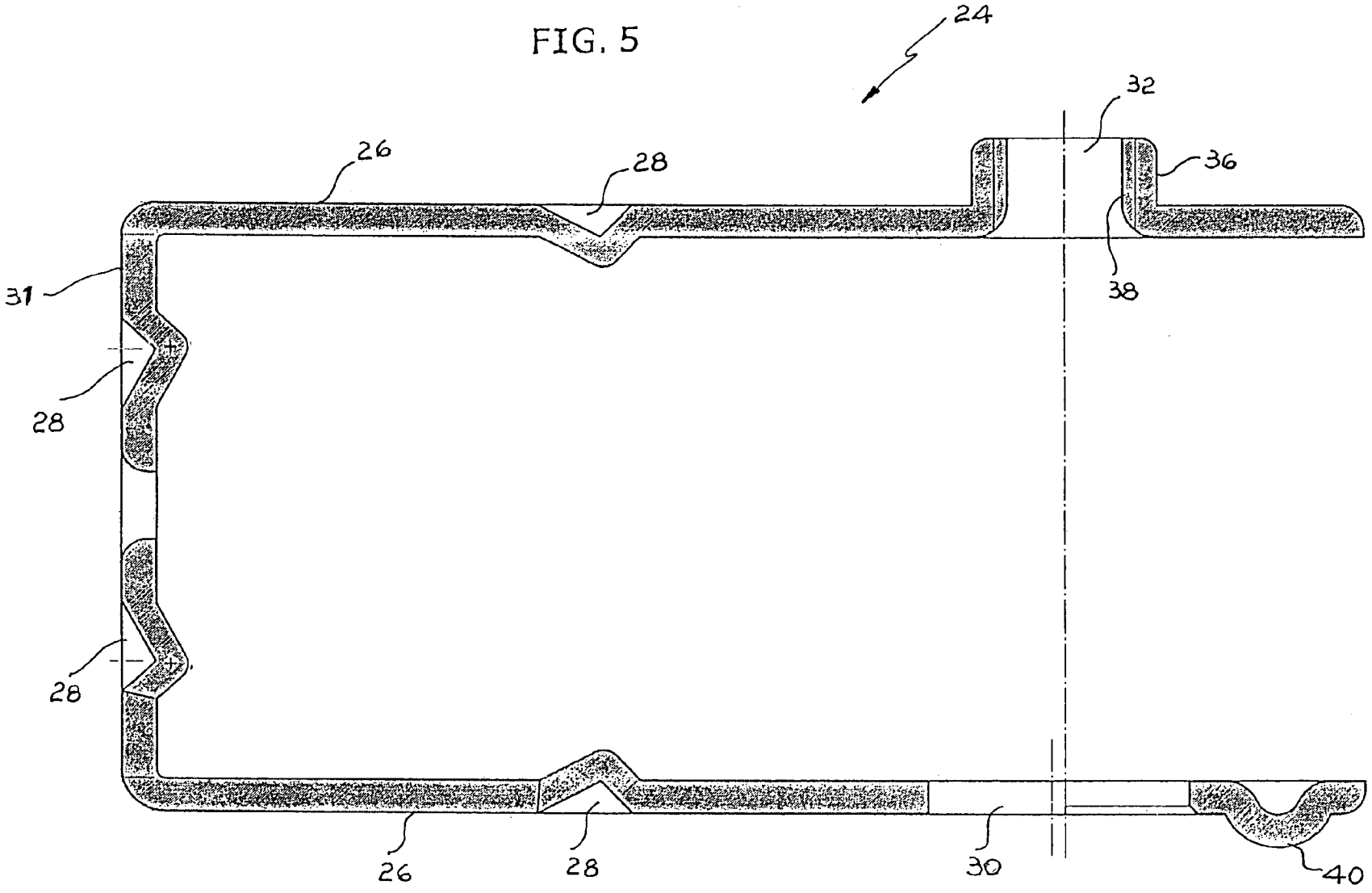
FIG. 5 is a schematic view of a longitudinal section of the connection element or hose clamp constraining among them the components of the shelving of FIG. 1.
Figure 7:
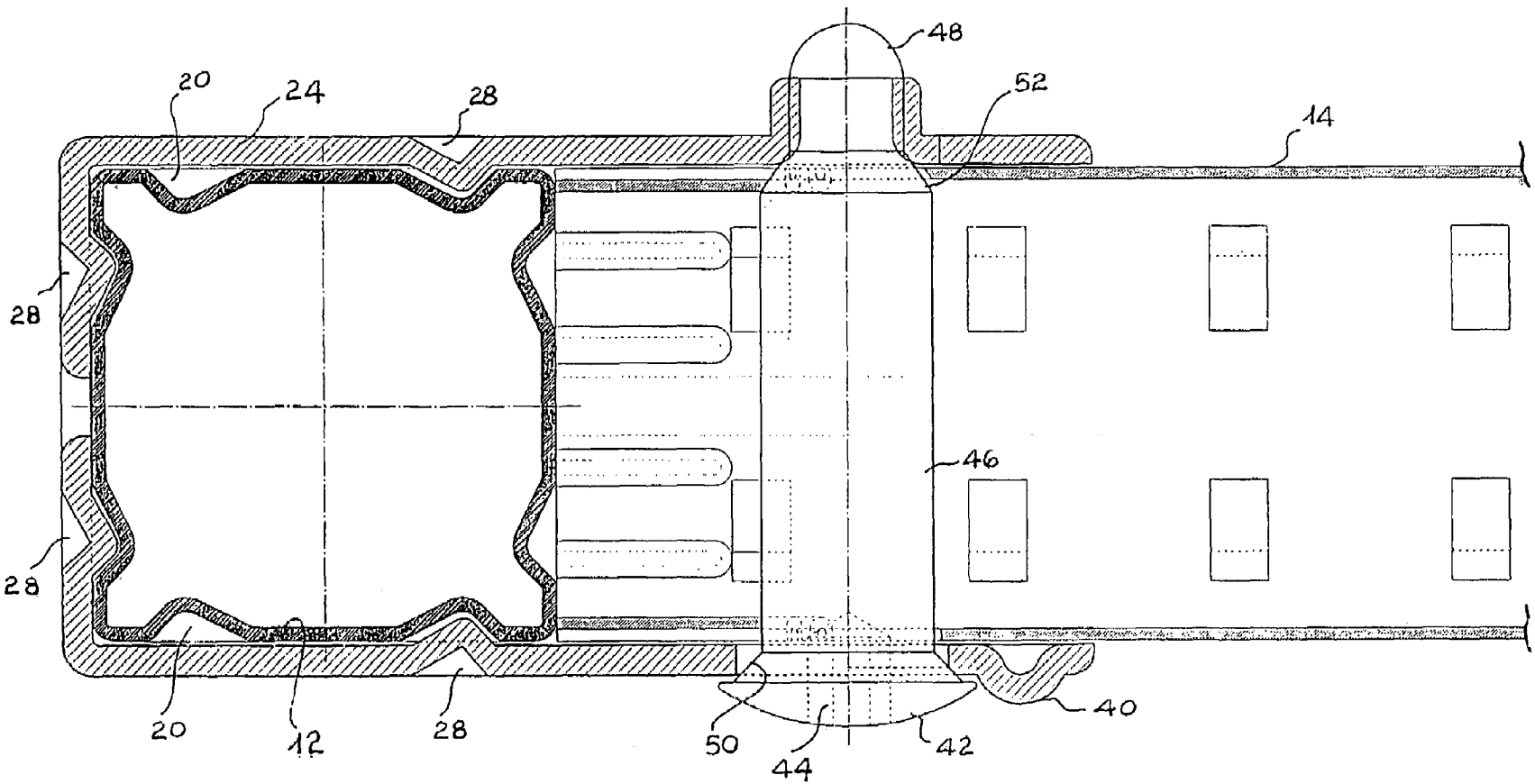
FIG. 7 is a schematic view of the section of a hose clamp coupled and fastened to a riser.
Figure 8:
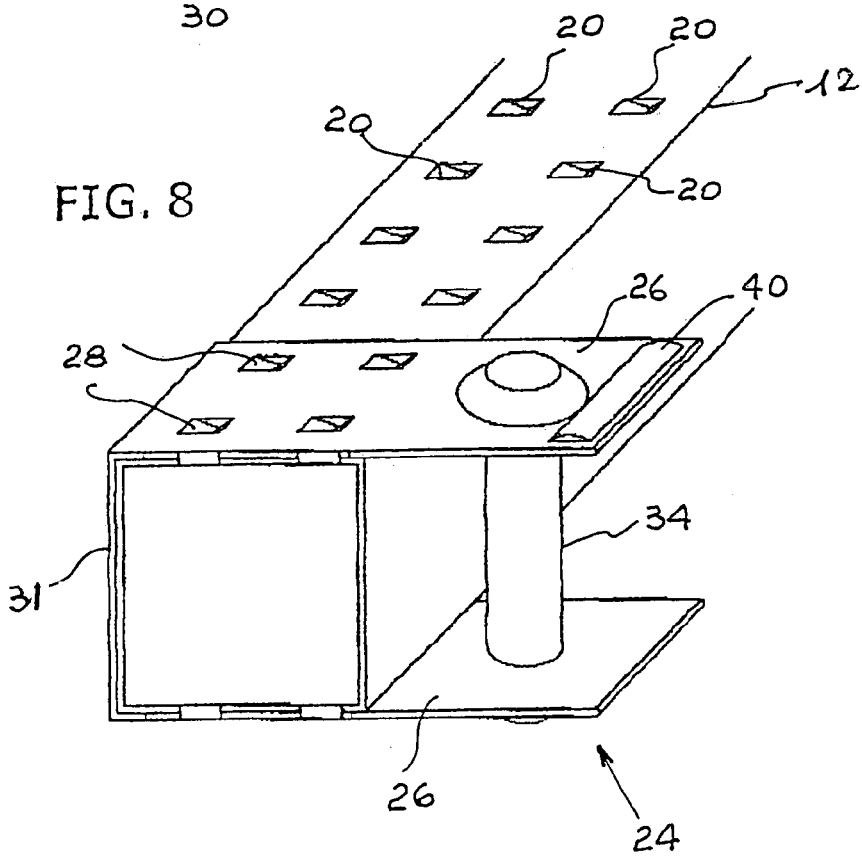
FIG. 8 is a perspective schematic view of the same hose clamp coupled and fastened to a riser.

According to the invention, said risers 12, along the faces defining the side surface 12', are provided with a plurality of shaped recesses 20 having depth H and defined by opposite walls 23-24 obtained by moulding or partial embossing of the sheet before its folding which originates the quadrangular section and the subsequent longitudinal soldering along the junction line, marked with 22, of the edges. In the preferred embodiment of the Figures, said recesses 20 preferably represent a quadrangular base and a conical developing embossing in the axial direction, ending with a basically tapered portion. The depth H of the recesses 20 is indicatively comprised between 1.0 and 3.0 mm. The recesses 20 are preferably obtained along all the faces of the risers 12, they are horizontally and vertically aligned among them and formed near the vertexes or edges 21 of the same risers. As shown in particular in FIGS. 2 and 3, the opposite walls 23-25 of said recesses 20 are preferably inclined with a different angulation. The recesses 20 form, as described here below, the same number of connection points at different heights of the horizontal elements of the shelving, i.e. longitudinal members 14 and cross members 16 and this connection is obtained, according to the invention, by means of the metal hose clamps 24, schematized in FIGS. 5, 7 and 8. The hose clamps 24 are made of "U" folded sheets sized in such a way to embrace three faces of the risers 12 upon which they are elastically put on by temporary divarication of the opposite sides or horizontal, and parallel branches marked with 26. Along said branches 26 of each hose clamp 24, at least one shaped or depressed recess or impression 28 whose shape and development are complementary to the one of the recesses 20 of the risers 12. Even along the vertical branch 31 of the hose clamp 24 at least one similar impression 28 is obtained, preferably two impressions for the engagement in the same number of recesses 20 of a face of the riser 12. Near the relevant free ends of the horizontal branches 26 of the hose clamps 24, opposite pass-through holes 30, 32 for the insertion of a connection mean constituted by a pin 34 which is partly threaded and schematized in detail in FIG. 6 are obtained by mechanical drilling or shearing operations or the like. At least one of said pass-through openings, for example the one marked with 32 in FIG. 5, is delimited by a collar 36 which is integrally obtained with the hose clamp 24 and is internally provided with thread 38. At least near the pass-through opening 30, which is obtained on the opposite horizontal branch of the hose clamp 24, a stiffening rib 40 having, by way of example, a semicircular profile and a vertical development is preferably obtained.

Figure 9:
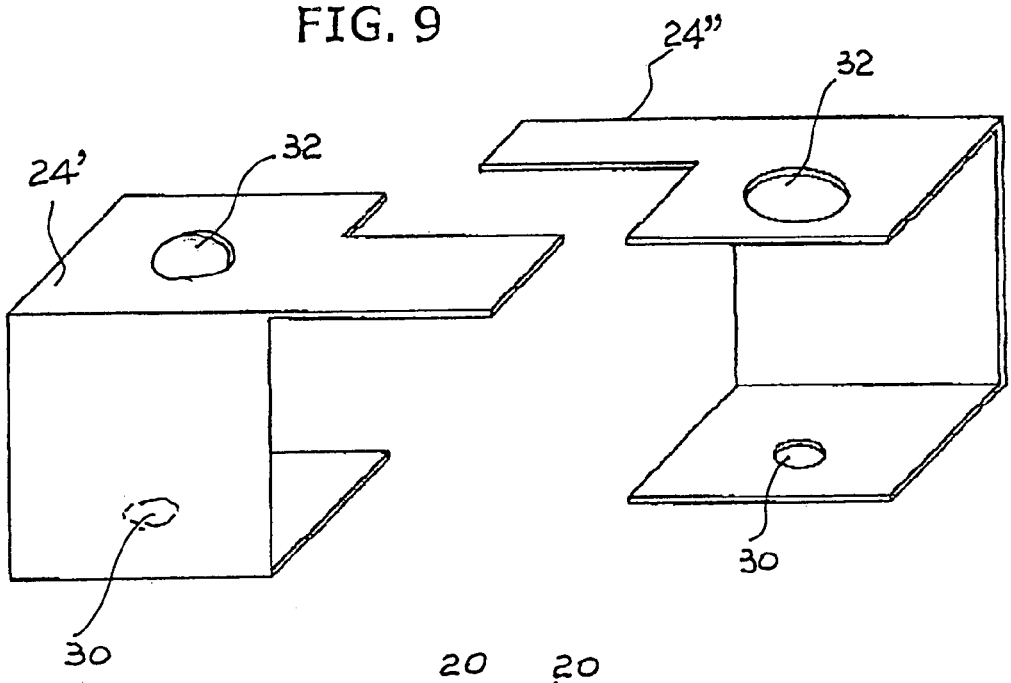
FIG. 9 is a perspective schematic view of a hose clamp obtained in two half parts which are complementary between them.

The pin 34 connects and steadily constrains one or more of the horizontal elements 14, 16 through the hose clamp 24 to the risers 12; each of them is provided with a pass-through hole for the same pin. In case of connection to the riser 12 of one horizontal element 14 or 16, as schematized in FIG. 7, the hose clamp 24 is of the type described and shown in FIGS. 5, 7 and 8, while in case of connection of two horizontal elements 14 or 16 developing from opposite ends of a riser 12, this hose clamp 24 is split, i.e. it is divided in two complementary half parts 24' and 24" as schematized in FIG. 9.

Each of the half parts 24' and 24" of the hose clamp is obviously provided with pass-through openings 30 and 32 to insert the pin 34 and with the shaped and depressed impressions 28.

Said pin 34 comprises: a head 42 wherein a shaped seat 44 for a conventional operation wrench is obtained; a rod 46 and an integral end 48 provided with a thread complementary to the one of the collar 36 of the hose clamps 24, 24' and 24".

According to a further and advantageous feature of the invention, the pin 34 is provided with two conical portions 50, 52 which are respectively obtained close to the head 42 and of the threaded end 48. The pass-through holes obtained on the horizontal elements 14, 16 to be connected to the risers 12 and the openings 30, 32 of the hose clamps 24 are slightly misaligned among them when the same hose clamps are put on the mentioned risers. Therefore, the function of the conical portions 50 and 52 of the pins 34, is the tightening of each hose clamp 24 to the riser 12 so that the initial misalignment and backlash existing between the depressed impressions 28 of the same hose clamps and recesses 20 of the risers is removed.

Figure 4:
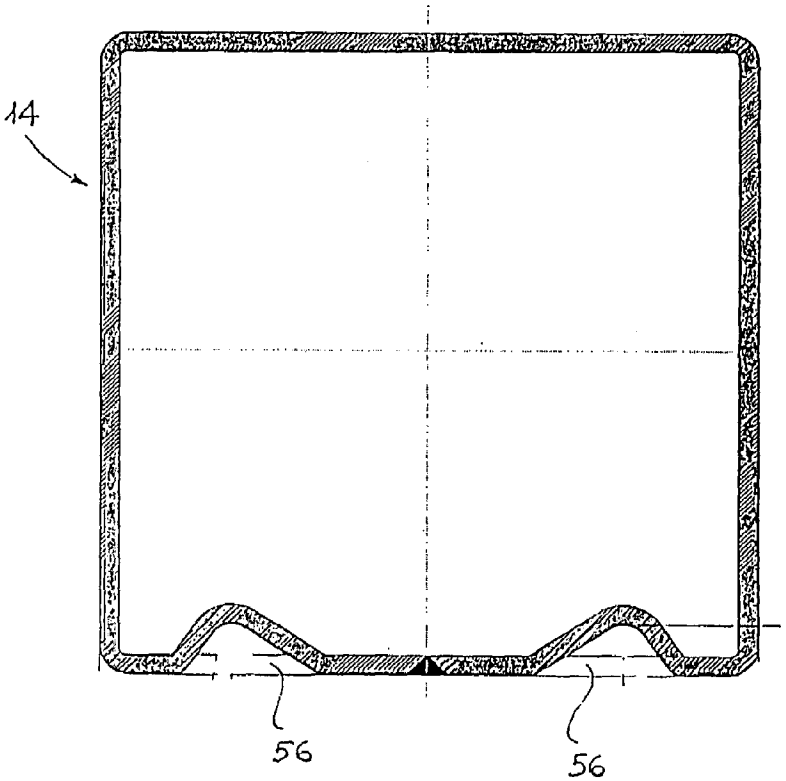
FIG. 4 is a schematic view of the cross section of the longitudinal member or horizontal element of the shelving of FIG. 1.

In this way, thanks to the initial misalignment of the holes and to the conical-shaped areas 50 and 52 of the pins 34, the coupling among the elements 12 and 14, 16 is extremely accurate and assures the stability of the load. As schematized in FIG. 7, the connection points develop on three faces of the risers 12; in this way a steady constraint among the vertical elements or risers 12 and longitudinal elements 14 or cross members 16 without projecting hooks which could lead to the creation of openings or slots in the same risers is assured. Anyway, the longitudinal members 14 and/or the cross members 16 can be provided with multiple small holes 56 on the lower side 14' facing the floor surface, as schematized in FIG. 4, in order to remove possible washing residuals of the shelving 10 with high pressure machines.

Figure 11:
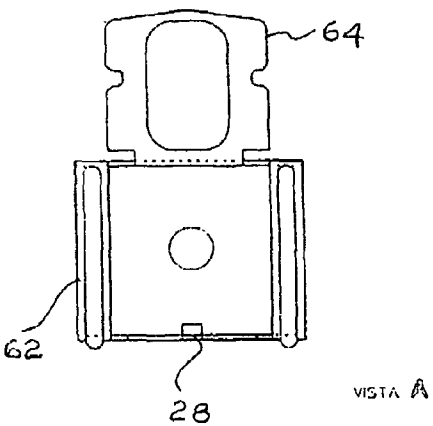
FIGS. 10, 11 and 12 represent the same number of side schematic views of a support element or section divider which can be associated to the longitudinal members and cross members of the shelving.
Figure 10:
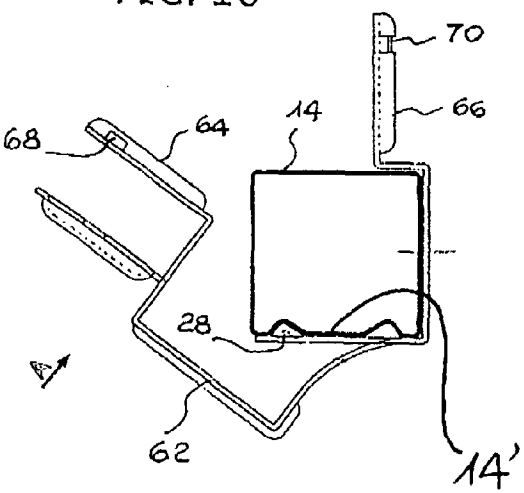
Figure 12:
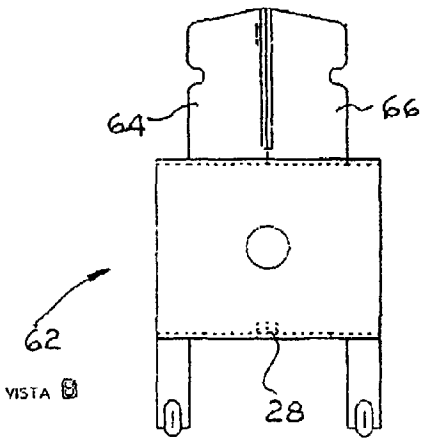

According to a further and advantageous feature of the invention, some spacing elements or section dividers 62 schematized in FIGS. 10, 11 and 12, can be associated to the shelving 10. Said elements are constituted by a sheet folding onto itself, suitable for embracing a longitudinal member 14 or a cross member 16 in order to form an engaging support for additional longitudinal members in case of shelving 10 with an angular development which does not have front risers as schematized in FIG. 1.

On the upper face, the spacing element or section divider 62 is provided with two coupled integral tongues 64 and 66 which can be snap engaged in approach between them by means of a projection 68 obtained on one of the tongues and a complementary recess 70 obtained on the other tongue.

The spacing element 62 is pre-shaped according to the configuration of the horizontal element it circumscribes and, once installed, it shows the two tongues 64, 66 approached between them.

Upon them, a horizontal element similar to a longitudinal member 14 provided with slits wherein the same tongues abut is put.

In the same way as the hose clamps 24, 24', 24", the spacing element 62 can be provided with one or more shaped and depressed impressions 28 engaging in correspondent recesses obtained along the base or lower face of the longitudinal member 14.

As can be noticed from the previous description, the advantages obtained by the invention are clear.

In the improved modular shelving of the present invention the risers or vertical elements do not have openings or slits deriving from the creation of hooks to engage with the longitudinal members and the cross members so that the shelving in its whole can be installed in environments wherein a high hygienic standard is required.

Thanks to the recesses and the shaped impressions of the risers and of the hose clamps for the connection with the relevant locking pin the stability and the high capacity of the same shelving are assured.

The layout of the spacing elements or section dividers which can be easily applied to the horizontal elements is also advantageous.

Even though the present invention has been described above with reference to one embodiment which is given only by way of non-limitative example, many variants and changes will be clear to a technician according to the above-mentioned description. Therefore the present invention is meant to include all changes and variants falling within the protective scope of the following claims.

The invention claimed is:

1. A modular shelving (10) made of metal such as stainless steel or other suitable material, comprising:

(a) a plurality of risers or vertical elements (12) each having a polygonal section defining a side surface having a plurality of faces;

(b) a plurality of shaped recesses (20) formed on at least two of the faces of each riser side surface, said plurality of recess (20) being horizontally and vertically aligned on said at least two side surface faces of the respective risers;

(c) a plurality of horizontal elements including longitudinal members (14) and cross members (16) connected to said risers (12) to form supports for shelves (18); and (d) a plurality of metal clamps (24, 24', 24") adapted for connecting said horizontal elements to said risers and comprising opposite horizontal parallel branches (26) and a vertical branch (31), each clamp embracing a respective riser and having depressions (28) formed thereon shaped and developed complimentary to the recesses (20) on said riser so as to engage therein to secure the clamp on the riser, each clamp engaging with at least one longitudinal member and/or cross member to which the opposite horizontal parallel branches of said clamp are constrained by a transverse connection element (34) which passes through aligned openings in said opposite horizontal parallel branches and said at least one longitudinal member and/or cross member.

2. The shelving according to claim 1, wherein each riser has an X and Y axis and said shaped recesses (20) are obtained by moulding or partial embossing and represent a quadrangular base and an embossing that conically develops towards the X and Y axes of the risers (12) ending with a basically tapered portion.

3. The shelving according to claim 1, wherein shaped recesses (20) have a depth (H) comprised between 1.0 and 3.0 mm.

4. The shelving according to claim 1, wherein the recesses (20) are formed near the vertexes or edges (21) along all the faces of the risers (12) and they are horizontally and vertically aligned among them, the recesses are formed having opposite walls (23-25) which are inclined with a different angulation.

5. The shelving according to claim 1, wherein the metal clamp (24) is constituted by a "U" shaped thin sheet defining opposite and parallel branches (26), at least one of the depressions (28) whose shape and development are complementary to the recesses (20) of the risers (12) is obtained on the opposite horizontal and parallel branches (26) of the clamp (24).

6. The shelving according to claim 1, wherein the metal clamp (24) is provided with at least one of the depressions (28) along a vertical branch (31).

7. The shelving according to claim 1, wherein the metal clamp (24) is provided with a pass-through opening (30-32), near relevant ends of the opposite and parallel branches (26), at least one pass-through opening being delimited by a collar (36) with inner thread (38), in the openings (30-32) the connection element (34) is inserted, and engages a longitudinal member (14) and/or a cross member (16) provided with a complementary pass-through hole.

8. The shelving according to claim 7, wherein the connection element (34) is constituted by a pin comprising a head (42) having a shaped seat (44) for an operation wrench, a rod (46) and an integral end (48) provided with a thread being complementary to inner thread (38 , of the collar (36) of the metal clamp (24); the pin being provided with two conical portions (50-52) which are respectively obtained close to the head (42) and of the threaded end (48) of the pin.

9. The shelving according to claim 8, wherein the pass-through holes obtained on the longitudinal members (14) and on the cross members (16) and the openings (30-32) of the clamp (24) are slightly misaligned among them before the tightening of the pin (34) engaging into the thread (38) of the collar (36) of the metal clamp (24).

10. The shelving according to claim 7, wherein the metal clamps (24, 24', 24") are provided with a stiffening rib (40) having a semicircular profile and a vertical development, obtained near the pass-through opening (30) opposite to the opening (32) delimited by the collar (36).

11. The shelving according to claim 1, wherein the metal clamp (24) is constituted by two complementary half parts (24', 24"), each of them being provided with pass-through openings (30-32) and of depressions (28).

12. The shelving according to claim 1, which comprises a plurality of spacing elements or section dividers (62), each being constituted by a thin sheet which can be folded onto itself and suitable for embracing a longitudinal member (14) or a cross member (16), each section divider being provided with two coupled tongues (64, 66) on its upper side, which can be snap engaged through relevant projections and recesses (68-70).

13. The shelving according to the claim 12, wherein the section divider (62) is provided with at least one shaped depression (28) to engage with the correspondent recesses or openings obtained along a lower side (14') of the longitudinal members (14).

14. The shelving according to claim 1, wherein the longitudinal members (14) and/or cross members (16), are provided with a plurality of holes (56) on their lower side facing a floor surface.

* * * * *